US007080548B2

(12) United States Patent
Nakoji

(10) Patent No.: US 7,080,548 B2
(45) Date of Patent: Jul. 25, 2006

(54) DIAGNOSTIC DEVICE OF EVAPORATED FUEL PROCESSING SYSTEM AND THE METHOD THEREOF

(75) Inventor: Yasushi Nakoji, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 176 days.

(21) Appl. No.: 10/926,296

(22) Filed: Aug. 26, 2004

(65) Prior Publication Data

US 2005/0044941 A1 Mar. 3, 2005

(30) Foreign Application Priority Data

Aug. 28, 2003 (JP) ..... 2003-304924

(51) Int. Cl.
*G01M 15/00* (2006.01)

(52) U.S. Cl. ..... 73/118.1; 73/49.7

(58) Field of Classification Search ..... 73/40, 73/46, 47, 49.7, 116, 117.2, 117.3, 118.1, 73/119 R See application file for complete search history.

(56) References Cited

U.S. PATENT DOCUMENTS

| | | | | |
|---|---|---|---|---|
| 6,289,880 | B1 | 9/2001 | Yamaguchi et al. | |
| 2001/0049958 | A1* | 12/2001 | Yamaguchi et al. | 73/40.5 R |
| 2003/0192370 | A1* | 10/2003 | Amano et al. | 73/118.1 |
| 2004/0089063 | A1* | 5/2004 | Matsubara et al. | 73/118.1 |
| 2004/0173011 | A1* | 9/2004 | Nakoji | 73/118.1 |
| 2004/0231404 | A1* | 11/2004 | Yamaguchi et al. | 73/118.1 |
| 2005/0000273 | A1* | 1/2005 | Hosoya | 73/49.7 |
| 2005/0022588 | A1* | 2/2005 | Hayakawa et al. | 73/118.1 |
| 2005/0055144 | A1* | 3/2005 | Steckler et al. | 701/31 |

FOREIGN PATENT DOCUMENTS

| | | |
|---|---|---|
| JP | 2001-041116 | 2/2001 |
| JP | 2003-056417 | 2/2003 |

OTHER PUBLICATIONS

Copending U.S. Appl. No. 11/200,094 filed Aug. 10, 2005, entitled "Diagnostic Apparatus for Evaporative Emission Control System", and claiming 2004-234648 priority.
Copending U.S. Appl. No. 11/085,272, filed Mar. 22, 2005, entitled "Diagnostic Apparatus for Evaporative Emission Control System", claiming JP 2004-093477 priority.

(Continued)

*Primary Examiner*—Eric S. McCall
(74) *Attorney, Agent, or Firm*—Smith, Gambrell & Russell, LLP

(57) ABSTRACT

A valve control section of a diagnostic device for an evaporated fuel processing system closes an evaporated fuel processing system at closing timing at which a value of the internal pressure detected by an internal pressure detection section reaches a preset target pressure value after a negative pressure is introduced from an inlet system to the evaporated fuel processing system. A diagnostic section of the device compares the internal pressure value at diagnostic timing which is set so as to come after the closing timing with a preset criterion threshold value so as to execute a leak diagnosis of the evaporated fuel processing system. A calculation section of the device variably sets the diagnostic timing based on the intake negative pressure value detected by the intake pressure detection section. Thus, a time period required for an early diagnosis of the leak can be optimized.

8 Claims, 6 Drawing Sheets

OTHER PUBLICATIONS

Copending U.S. Appl. No. 10/926,295, filed Aug. 26, 2004 entitled "Diagnostic Device of Evaporated Fuel Processing System and the Method Thereof" and claiming JP 2003-304914.

Copending application, being filed concurrently herewith (Aug. 26, 2004) entitled "Diagnostic Device of Evaporated Fuel Processing System and the Method Thereof" and claiming JP 304914 priority.

* cited by examiner

DIAGNOSTIC DEVICE OF EVAPORATED FUEL PROCESSING SYSTEM AND THE METHOD THEREOF

BACKGROUND OF THE INVENTION

The present invention relates to a diagnostic device and a diagnostic method of an evaporated fuel processing system, in particular, to an early diagnosis of a leak in the evaporated fuel processing system including a fuel tank.

The present application claims priority from Japanese Patent Application No. 2003-304924, the disclosure of which is incorporated herein by reference.

In order to prevent a fuel evaporated in the fuel tank from being released to the atmosphere, an internal combustion engine including the evaporated fuel processing system is known. In this system, an evaporated fuel (evaporated gas) generated in the fuel tank is temporarily adsorbed by an adsorbent disposed in a canister. Then, the adsorbed evaporated fuel is released to an inlet system of the internal combustion engine through a purge passage under predetermined operating conditions. However, if apart of the system is broken or exploded for some reason, the evaporated fuel is released to the atmosphere. In order to prevent such a situation from taking place, while the evaporated fuel processing system including the fuel tank is being closed, the amount of a change in an internal pressure with elapsed time is monitored so as to execute a leak diagnosis for determining whether there is a leak in the evaporated fuel processing system or not (for example, see Japanese Patent Application Laid-Open Nos. 2001-41116 and 2003-56417).

Moreover, the execution of a so-called early diagnosis prior to the normal leak diagnosis based on the change amount with elapse of the time is also known. The early diagnosis is a method for determining if there is the leak by comparing the internal pressure of the evaporated fuel processing system at certain diagnostic timing with a predetermined criterion threshold value. If it is determined in the early diagnosis that no leak occurs, that is, if the internal pressure of the evaporated fuel processing system is smaller than the criterion threshold value, the subsequent leak diagnosis based on the change amount is cancelled to obtain the result of diagnosis that no leak occurs.

A state of the pressure in the evaporated fuel processing system, however, is not stabilized yet immediately after closing the system because it is affected by an intake negative pressure introduced from the inlet system. A certain time period is required to stabilize the state of the pressure in the evaporated fuel processing system. Accordingly, immediately after the closing, the phenomenon that the internal pressure of the evaporated fuel processing system keeps decreasing with the time below a target value, that is, an overshoot occurs. The degree of the overshoot depends on the intake negative pressure. As the negative pressure becomes deeper, the overshoot becomes larger.

In a conventional early diagnosis, a diagnostic timing is set uniformly and fixedly to the time when a predetermined time period elapsed after completing closing off the evaporated fuel processing system. In this case, it is necessary to set the diagnostic timing in consideration of the case where the largest overshoot occurs. Therefore, according to the conventional method of uniformly setting the diagnostic timing regardless of the degree of the overshoot, it is difficult to optimize the time period required for the early diagnosis in every intake negative pressure area.

SUMMARY OF THE INVENTION

The present invention was devised in view of above situations and has an object of optimizing a time period required for an early diagnosis of a leak.

In order to solve the above problem, a first aspect of the present invention provides a diagnostic device of an evaporated fuel processing system, which closes an evaporated fuel processing system including a fuel tank after introducing a negative pressure into the evaporated fuel processing system to execute a leak diagnosis of the evaporated fuel processing system. In the diagnostic device, an internal pressure detection section detects an internal pressure of the evaporated fuel processing system, whereas an intake pressure detection section detects an intake negative pressure of an inlet system. A control section closes the evaporated fuel processing system at a closing timing at which a value of the internal pressure detected by the internal pressure detection section reaches a preset target pressure value when the negative pressure is introduced from the inlet system to the evaporated fuel processing system. A diagnostic section compares the internal pressure value at a diagnostic timing which is set so as to come after the closing timing with a preset criterion threshold value so as to execute a leak diagnosis of the evaporated fuel processing system. A calculation section variably sets the diagnostic timing based on the intake negative pressure value.

In the first aspect of the present invention, it is preferred that the calculation section delays more the diagnostic timing determined on the basis of the closing timing as the intake negative pressure value detected by the intake pressure detection section becomes smaller, in other words, as the intake negative pressure of the inlet system becomes deeper. The calculation section may set the diagnostic timing based on an average value of the intake negative pressure values for a time period in which the negative pressure is introduced to the evaporated fuel processing system.

In the first aspect of the present invention, the diagnostic section determines that no leak occurs in the evaporated fuel processing system if the internal pressure value at the diagnostic timing is smaller than the criterion threshold value.

A second aspect of the present invention provides a diagnostic method of the evaporated fuel processing system, which closes the evaporated fuel processing system including a fuel tank after introducing the negative pressure into the evaporated fuel processing system to execute a leak diagnosis of the evaporated fuel processing system. According to the diagnostic method, as a first step, the negative pressure is introduced from an inlet system to the evaporated fuel processing system. As a second step, the evaporated fuel processing system is closed at the closing timing at which the internal pressure value detected as an internal pressure of the evaporated fuel processing system reaches a preset target pressure value. As a third step, the diagnostic timing coming after the closing timing is variably set based on the intake negative pressure value detected as the intake negative pressure of the inlet system. As a fourth step, the internal pressure value at the diagnostic timing is compared with the preset criterion threshold value so as to execute the leak diagnosis of the closed evaporated fuel processing system.

The third step preferably delays more the diagnostic timing determined on the basis of the closing timing as the intake negative pressure value becomes smaller. The third step may be a step of setting the diagnostic timing based on an average value of the intake negative pressure values for a time period in which the negative pressure is introduced to the evaporated fuel processing system.

The fourth step in the second aspect of the present invention includes a step of determining that no leak occurs in the evaporated fuel processing system if the internal pressure value at the diagnostic timing is smaller than the criterion threshold value.

According to the present invention, after the negative pressure is introduced from the inlet system to the processing system, the processing system is completely closed at the closing timing at which the internal pressure value reaches the target pressure value. The leak diagnosis of the processing system is executed by comparing the internal pressure value and the criterion threshold value with each other at the diagnostic timing just after the closing timing. In this case, the diagnostic timing is variably set on the basis of the negative pressure value. As a result, since a time period between the closing timing and the diagnostic timing can be appropriately set, the time period required for the leak diagnosis can be optimized.

BRIEF DESCRIPTION OF THE DRAWINGS

These and other objects and advantages of the present invention will become clear from following descriptions with reference to accompanying drawings, wherein.

DETAILED DESCRIPTION OF THE PREFERRED EMBODIMENTS

Figure 1:
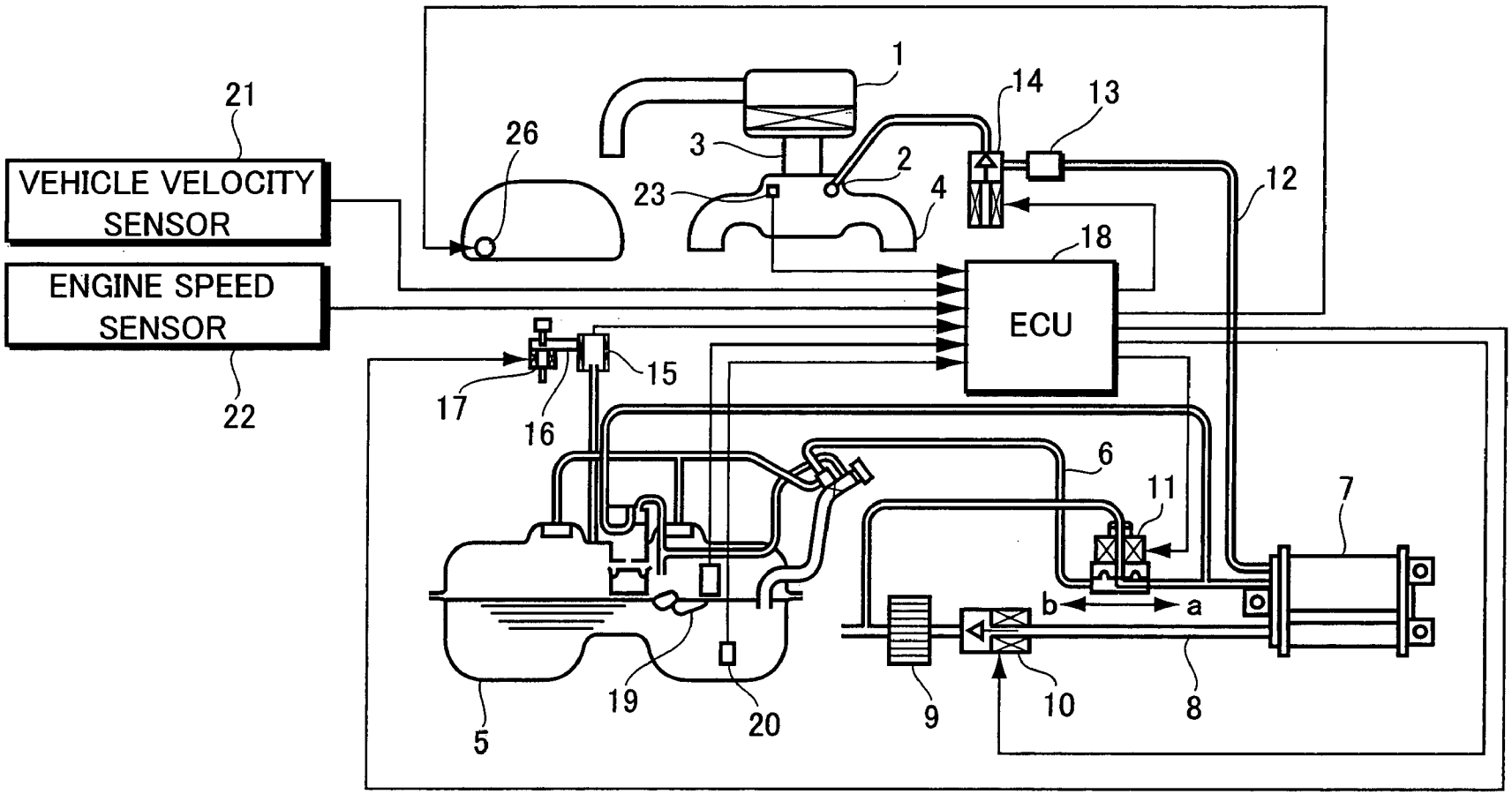
FIG. 1 is a block diagram showing a diagnostic device of an evaporated fuel processing system according to an embodiment of the present invention.

FIG. 1 is a block diagram of a diagnostic device of an evaporated fuel processing system according to an embodiment of the present invention. An airflow amount, from which a dust and the like present in an atmosphere is removed by an air cleaner 1, is controlled in accordance with an opening degree of an electric throttle valve (not shown). The throttle valve is provided for a throttle body 3 in an intake passage provided between the air cleaner 1 and an air chamber 2. The opening degree of the throttle valve (throttle opening degree) is set by an electric motor. The throttle opening degree is set by an output signal from a control device 18 (hereinafter, referred to as "ECU") composed mainly of a microcomputer and the like. The intake air of which amount of flow is controlled by the throttle opening degree flows through the air chamber 2 and an intake manifold 4 to be mixed with a fuel injected from injectors (not shown). Each of injectors is arranged so that its tip projects into the intake manifold 4 and is provided for each cylinder of an engine. The pressure-regulated fuel is supplied to each injector through a fuel pipe (not shown) in communication with the fuel tank 5. An air-fuel mixture formed within the intake manifold 4 flows into a combustion chamber of the engine by opening an intake valve. The air-fuel mixture is ignited by an ignition plug so as to combust the air-fuel mixture. As a result, a driving force of the engine is generated. The gas generated by the combustion is exhausted from the combustion chamber to an exhaust passage by opening an exhaust valve.

The evaporated fuel generated in the fuel tank 5 is released through the evaporated fuel processing system to the air chamber 2 of the inlet system. More specifically, the fuel tank 5 is in communication with a canister 7 through an evaporated fuel passage 6 provided at the top of the fuel tank 5. The evaporated fuel in the fuel tank 5 is adsorbed by an adsorbent such as activated carbon filled within the canister 7. After a gas in the canister 7, which does not contain any fuel components (in particular, hydrocarbon (HC) and the like), passes through a fresh air introduction passage 8 to be purified by a drain filter 9, the gas is released to the atmosphere. A drain valve 10 of which opening/closing is controlled by the ECU 18 is inserted into the fresh air introduction passage 8. In normal control, an electromagnetic solenoid is switched OFF, so that the drain valve 10 is set to be in an open state. On the other hand, in a leak diagnosis, the electromagnetic solenoid is switched ON in accordance with a control signal from the ECU 18, so that the drain valve 10 is set to be in a close state.

A pressure control solenoid valve 11 (hereinafter, referred to as "PCV") having a mechanical pressure regulating mechanism is inserted into the evaporated fuel passage 6 so as to regulate an internal pressure of the fuel tank 5. The PCV 11 mechanically opens and closes in accordance with a difference in a pressure between the internal pressure of the fuel tank 5 and the atmospheric pressure or in accordance with a difference in the pressure between the internal pressure of the fuel tank 5 and the internal pressure of the canister 7 in a normal control state where the electromagnetic solenoid is switched OFF. More specifically, if the internal pressure of the fuel tank 5 becomes higher than the atmospheric pressure, the PCV 11 opens so that the evaporated fuel in the fuel tank 5 flows toward the canister 7 (in a direction from b to a in the evaporated fuel passage 6 in FIG. 1). As a result, a state of the pressure in the fuel tank 5 is regulated to be the atmospheric pressure so as to restrain the internal pressure of the fuel tank 5 from increasing. On the other hand, if the internal pressure in the fuel tank 5 becomes lower than the internal pressure of the canister 7, that is, if the internal pressure of the fuel tank 5 becomes negative, the PCV 11 also opens so that the gas in the canister 7 flows toward the fuel tank 5 (in a direction from a to b in the evaporated fuel passage 6 in FIG. 1). As a result, since the pressure in the fuel tank 5 is regulated to the atmospheric pressure, the internal pressure of the fuel tank 5 is restrained from lowering. Owing to such a mechanical pressure regulating mechanism, the fuel tank 5 can be effectively prevented from being deformed or broken. On the other hand, in the leak diagnosis, the electromagnetic solenoid is switched ON in accordance with the control signal from the ECU 18 so that the PCV 11 is forced to open. In this state, the gas flows from any direction, that is, from the fuel tank 5 to the canister 7 or from the canister 7 to the fuel tank 5 in accordance with the pressure difference between the internal pressure of the fuel tank 5 and that of the canister 7.

On the other hand, a chamber 13 is formed in a purge passage 12 communicating between the canister 7 and the air chamber 2 of the inlet system. In its downstream, a purge control solenoid valve 14 (hereinafter, referred to as "purge valve") is inserted. The purge valve 14 is a duty solenoid valve of which opening degree is set in accordance with a duty ratio of the control signal output from the ECU 18. In the leak diagnosis, the opening degree of the purge valve 14 is regulated in accordance with a diagnostic condition. On the other hand, in a normal control, the opening degree of the purge valve 14 is controlled in accordance with operating states of a vehicle, thereby controlling the amount of purge. The chamber 13 on the upstream side of the purge valve 14 is provided so as to eliminate airflow or pulsation noises generated by the opening/closing operations of the purge valve 14.

A pressure sensor 15 for detecting the internal pressure of the fuel tank 5 is arranged above the fuel tank 5. The pressure sensor 15 detects the pressure difference between the atmospheric pressure and the internal pressure of the fuel tank 5 as an internal pressure and outputs the internal pressure as an internal pressure value $P_{tank}$ to the ECU 18. In an atmosphere introducing passage 16 for introducing the atmosphere to the pressure sensor 15, a tank internal pressure switching solenoid valve 17 (hereinafter, referred to as "tank internal pressure valve") of which opening/closing is controlled by the ECU 18 is provided. The reason why the valve 17 is provided is as follows. If the atmospheric pressure varies with an altitude change occurring while the vehicle is running, the internal pressure value $P_{tank}$ varies even when an absolute pressure in the fuel tank 5 is constant. Therefore, the valve 17 is provided so as to cope with such a variation. In the normal operation, the electromagnetic solenoid is switched OFF so as to set the tank internal pressure valve 17 in an open state. As a result, the atmosphere introducing passage 16 is open to the atmosphere. On the other hand, in the leak diagnosis, the electromagnetic solenoid is switched ON in response to the control signal from the ECU 18 so as to set the tank internal pressure valve 17 in a close state. As a result, the pressure state in the atmosphere introducing passage 16 between the pressure sensor 15 and the tank internal pressure valve 17 is regulated to be the atmospheric pressure.

The ECU 18 performs calculations for the fuel amount injected from the injectors, an injection timing thereof, an ignition timing of the ignition plug, the throttle opening degree, and the like in accordance with a control program stored in a ROM. The ECU 18 outputs the control amount (a control signal) calculated by the above calculations to various actuators. The ECU 18 also executes the leak diagnosis for the above-described evaporated fuel processing system including the fuel tank 5. As information necessary for the ECU 18 to execute the leak diagnosis, detection signals from the pressure sensor 15 and various sensors 19 to 23 and the like are given. The fuel level sensor 19 is attached within the fuel tank 5 so as to detect a level L of the remaining fuel amount. A fuel temperature sensor 20 detects a fuel temperature T. A vehicle velocity sensor 21 detects a vehicle velocity V. An engine speed sensor 22 detects the engine speed Ne. An intake pressure sensor 23 detects an intake negative pressure on the downstream of the throttle valve constituting a part of the inlet system (for example, the air chamber 2) and outputs the detected intake negative pressure as an intake negative pressure value $P_{in}$ to the ECU 18.

Figure 2:
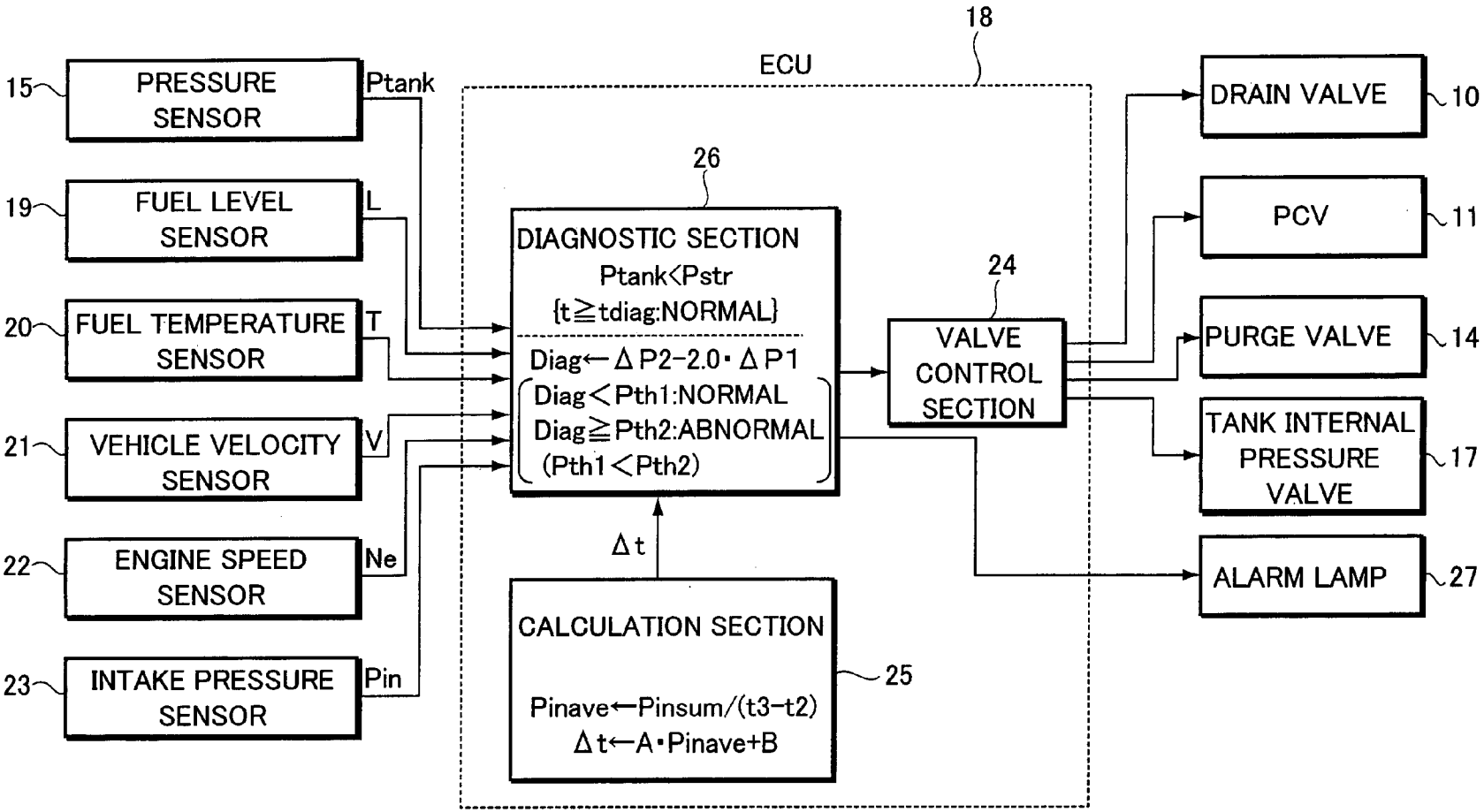
FIG. 2 is a functional block diagram of an ECU.

FIG. 2 is a functional block diagram of the ECU 18. When the ECU 18 for executing the leak diagnosis is examined in view of its functionality, the ECU 18 has a valve control section 24, a calculation section 25, and a diagnostic section 26. The valve control section 24 outputs the control signal for instructing an open/close state of each of the valves 10, 11, and 17 in accordance with conditions of the leak diagnosis in the diagnostic section 26. The control signals switch the electromagnetic solenoid ON/OFF so as to set the open/close state of the corresponding valves 10, 11, and 17. The valve control section 24 outputs the control signal to the purge valve 14 so as to set the opening degree of the purge valve 14 in accordance with a duty ratio of the control signal. The calculation section 25 variably sets diagnostic timings in an early diagnosis based on the intake negative pressure value $P_{in}$ detected by the intake pressure sensor 23. The diagnostic section 26 compares the internal pressure value of the evaporated fuel processing system at the set diagnostic timing (precisely, the internal pressure value $P_{tank}$ of the fuel tank 5 in communication with the evaporated fuel processing system) and a preset pressure value (in this embodiment, a measurement start negative pressure value $P_{str}$) with each other so as to execute the leak diagnosis of the evaporated fuel processing system. If the internal pressure value $P_{tank}$ is smaller than the measurement start negative pressure value $P_{str}$, it is determined that there is no leak in the evaporated fuel processing system (early diagnosis) On the other hand, if the internal pressure value $P_{tank}$ is equal to or larger than the measurement start negative pressure value $P_{str}$, the leak diagnosis is executed on the basis of the variation amount with the elapsed time. The diagnostic section 26 gives the result of a diagnosis "abnormal" if the occurrence of a leak in the evaporated fuel processing system is determined, whereas it gives the result of the diagnosis "normal" if the leak absence is determined.

Figure 3:
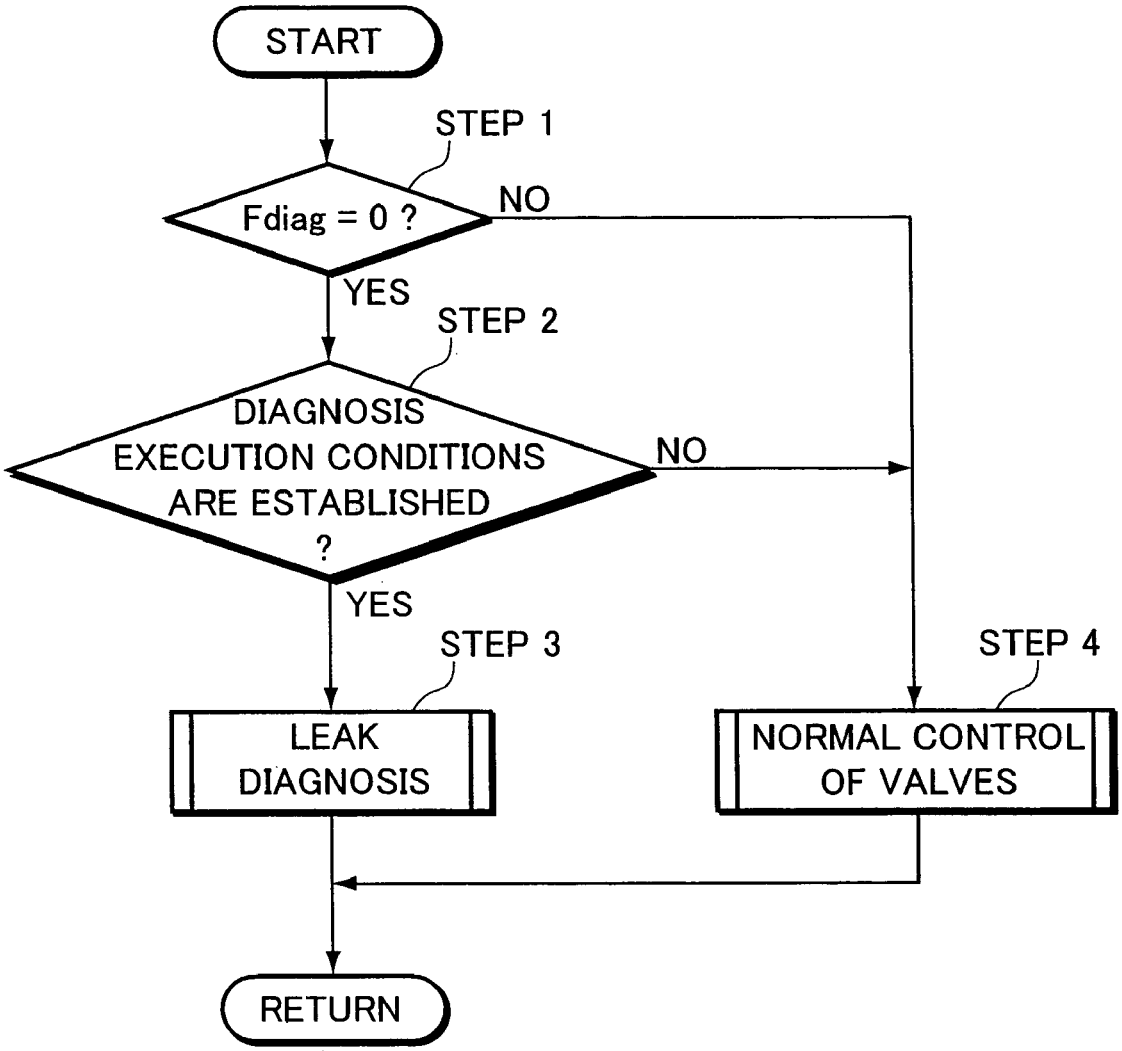
FIG. 3 is a flowchart of a leak diagnosis routine according to the embodiment of the present invention.

FIG. 3 is a flowchart of a leak diagnosis routine according to this embodiment. The routine is used at predetermined intervals (for example, 10 ms) so as to be executed by the ECU 18 between a start and a stop of the engine, that is, in one operating cycle. A leak diagnosis target in this embodiment is the evaporated fuel processing system including the fuel tank 5 (the evaporated fuel passage 6, the canister 7, the purge passage 12 communicating between the purge valve 14 and the canister 7, and the like).

First, at step 1, it is determined whether a diagnosis execution flag $F_{diag}$ is "0" or not. The diagnosis execution flag $F_{diag}$ is initially set to "0". When the leak diagnosis is properly completed, that is, the result of diagnosis of "normal" or "abnormal" is obtained within one operating cycle, the diagnosis execution flag $F_{diag}$ is set to "1". Therefore, once the diagnosis execution flag $F_{diag}$ is changed from "0" to "1" at a certain time, a leak diagnosis at step 3 is skipped so that the process proceeds to step 4 in accordance with the determination at step S1 as long as the operating cycle continues therefrom. In this case, as described below, the ECU 18 exits the routine after the execution of normal control of the valves. On the other hand, if it is determined to be "YES" at step 1, that is, the leak diagnosis is not completed yet, the process proceeds to step 2.

At step 2, it is determined whether diagnosis execution conditions are established or not. The diagnosis execution conditions define an operating state suitable for the leak diagnosis. In order to avoid the diagnosis execution in an inappropriate operating state, the determination at step 2 is provided prior to the leak diagnosis at step 3. As the diagnosis execution conditions, for example, the following conditions (1) to (4) can be given.

Diagnosis Execution Conditions (1) A predetermined time period or more elapses after the engine start (for example, 325 sec).

Immediately after the engine start, the engine speed is not stabilized at the internal pressure value $P_{tank}$. As a result, there arises a possibility of erroneous determination in the leak diagnosis. Therefore, if a time period elapsing after the engine start is short, it is determined that the engine speed is not stabilized-for the execution of the leak diagnosis.

(2) The fuel temperature T is within the range of a predetermined temperature (for example, $-10 \leqq T \leqq 35°$ C.).

If the fuel temperature T is high, the amount of a generated evaporated fuel becomes large. As a result, it becomes difficult to determine whether there is the leak in the evaporated fuel processing system including the fuel tank 5 or not. Therefore, the fuel temperature T is detected by using the fuel temperature sensor 20. If the fuel temperature T does not fall within an appropriately set range, the execution of the leak diagnosis is not permitted.

(3) Fuel shake in the fuel tank is small.

Under the condition where the fuel in the fuel tank 5 is widely shaken, the pressure in the fuel tank 5 largely varies. As a result, there arises a possibility of erroneous determination in the leak diagnosis. Thus, the fuel shake in the fuel tank 5 is specified by using the fuel level sensor 19. The fuel shake can be estimated from the change amount $\Delta L$ of the amount of fuel L detected by the fuel level sensor 19 per set time. More specifically, if the change amount $\Delta L$ is larger than the appropriately set criterion value, it is determined that the fuel shake is large not to permit the execution of the leak diagnosis.

(4) The engine speed Ne and the vehicle velocity v are respectively equal to or larger than predetermined values ($Ne \geqq 1500$ rpm, $v \geqq 70$ km/h).

When the vehicle runs at a low speed, its running condition is unstable. Therefore, there arises a possibility of erroneous determination in the leak diagnosis. Accordingly, the leak diagnosis is executed when the vehicle runs at high speed at which the running condition is relatively stable.

If it is determined to be NO at step 2, that is, if the diagnosis execution conditions are not all established, the leak diagnosis at step 3 is skipped so that the process proceeds to step 4. At step 4, the process exits this routine after a normal control execution of the valves described below.

Normal Control of Valves

Drain valve 10 opened

PCV 11 opened/closed by a mechanical mechanism

Purge valve 14 opened/closed in accordance with the operating condition

Tank internal pressure valve 17 opened

On the other hand, if it is determined to be YES at step 2, that is, if all the diagnosis execution conditions are established, the process proceeds to step 3.

Figure 4:
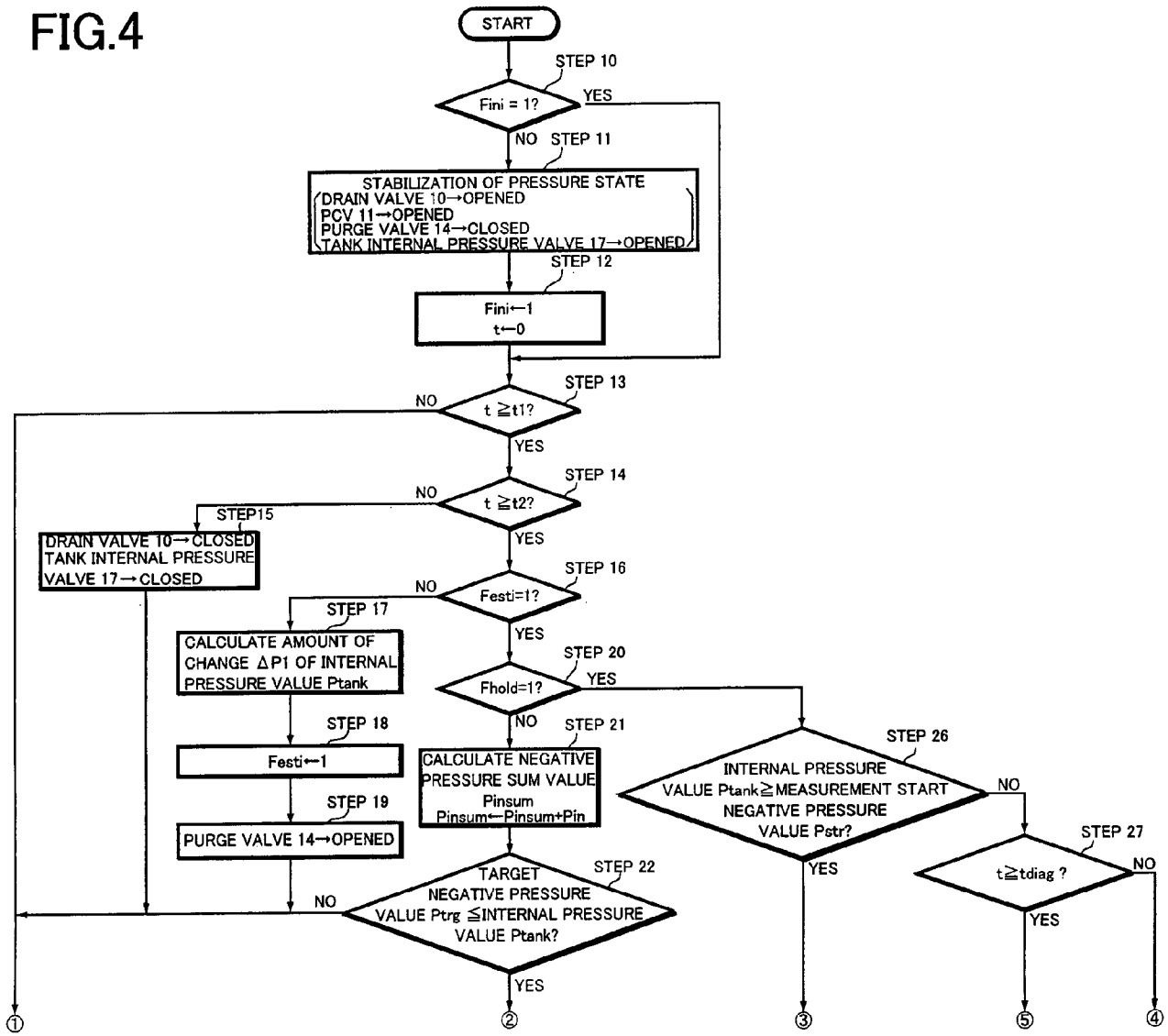
FIG. 4 is a flowchart showing the details of the leak diagnosis routine at step 3 in FIG. 3.
Figure 5:
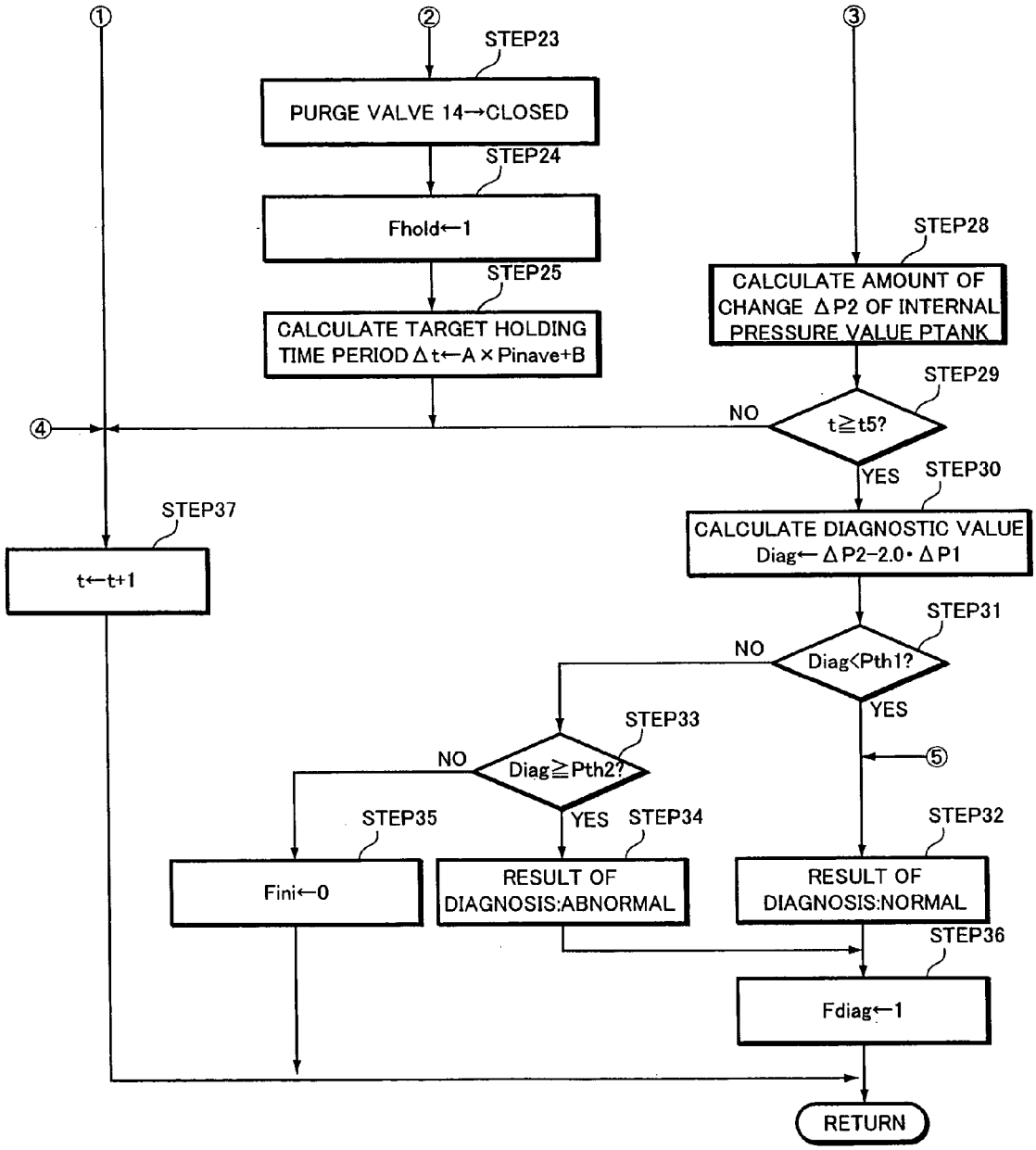
FIG. 5 is a flowchart subsequent to that of FIG. 4.
Figure 6:
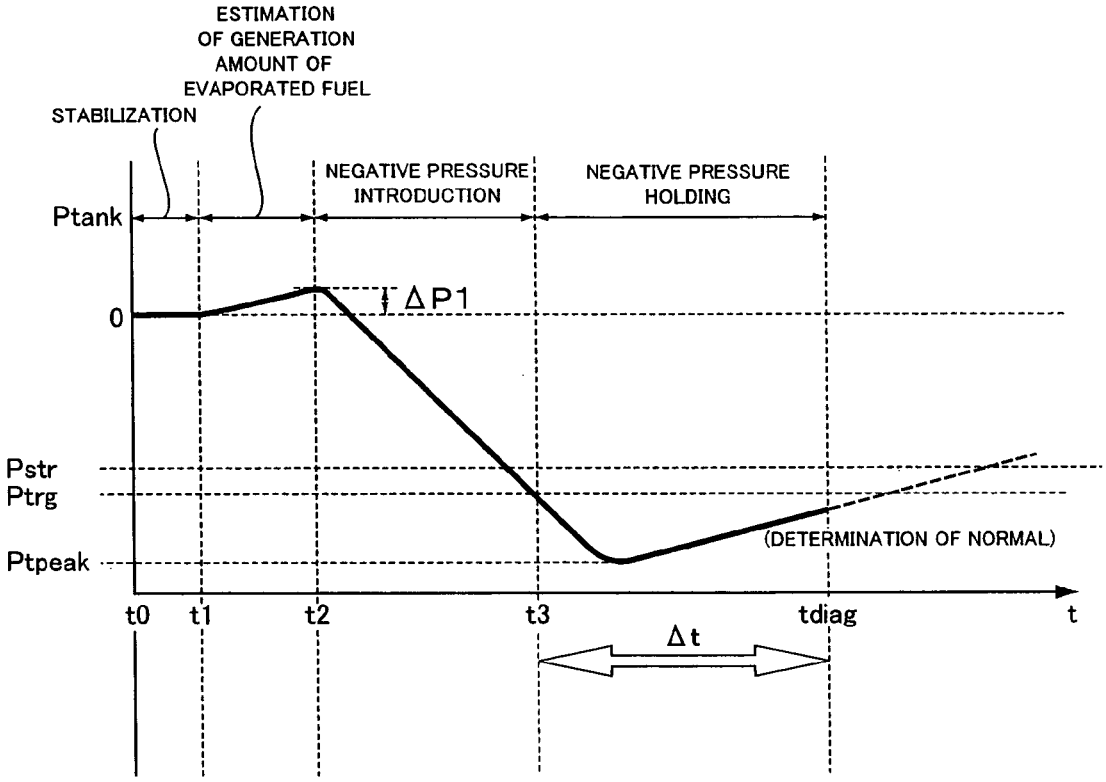
FIG. 6 is a timing chart in an early leak diagnosis.
Figure 7:
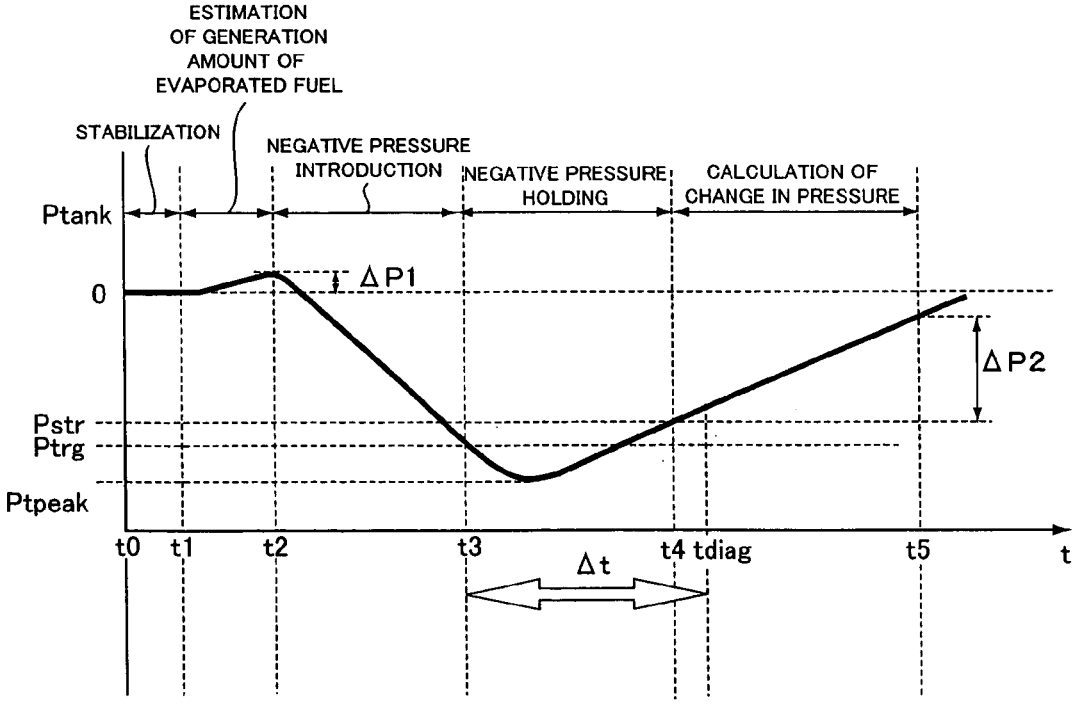
FIG. 7 is a timing chart in a normal leak diagnosis.

FIGS. 4 and 5 are the flowcharts showing the details of the leak diagnosis routine at step 3. FIGS. 6 and 7 are the timing charts in the leak diagnosis. The leak diagnosis at step 3 proceeds in principle in the order of: a stabilization pressure in the evaporated fuel processing system (a time period from t0 to t1); estimation of the amount of evaporated fuel generated (the time period from t1 to t2); introduction of a negative pressure to the evaporated fuel processing system (the time period from t2 to t3); negative pressure holding (the time period from t3 to t4); and a change calculation in the pressure (the time period from t4 to t5). From this process series in the leak diagnosis, the result of diagnosis "normal" or "abnormal" is obtained, in principle, on the basis of the change amount in the internal pressure value $P_{tank}$ in the evaporated fuel processing system. As shown in the timing chart of FIG. 6, however, only when the internal pressure value $P_{tank}$ of the evaporated fuel processing system satisfies a predetermined condition at a certain diagnostic timing (in this embodiment, at the terminating time of the negative pressure holding, in other words, the starting time of the calculation of a change in pressure), the result of the diagnosis "normal" is given.

First, at step 10, it is determined if an initial determination flag $F_{ini}$ is "1" or not. The initial determination flag $F_{ini}$ is set to "0" in the following three cases:

(Case 1) In the first execution of this routine in the operating cycle;

(Case 2) In the execution of this routine immediately after it is determined to be NO at step 2; and (Case 3) In the execution of this routine immediately after the initial determination flag $F_{ini}$ is reset to "0" at step 35.

In the leak diagnosis, an open/close state of each of various valves 10, 11, 14, and 17 is set so that the atmospheric pressure in the evaporated fuel processing system including the fuel tank 5 is changed to a target negative pressure value $P_{trg}$. Then, by monitoring a change in the internal pressure value $P_{tank}$ detected by the pressure sensor 15, the leak diagnos is of the system is executed. Therefore, there arises a necessity of resetting the internal pressure of the evaporated fuel processing system including the fuel tank 5 to the atmospheric pressure in the first execution of the diagnostic cycle (Case 1) or the re-execution of the diagnostic cycle (Case 2 or 3) in order to monitor the internal pressure value $P_{tank}$. Therefore, if the initial determination flag $F_{ini}$ is "0," the process proceeds to step 11 in accordance with the negative result of a determination at step 10. On the other hand, if the initial determination flag $F_{ini}$ is "1", namely, in the case where the leak diagnosis is continuous from the previous routine, steps 11 and 12 are skipped so that the process proceeds to step 13.

At step 11, the pressure in the evaporated fuel processing system is stabilized (a pressure is reset). More specifically, the purge valve 14 is closed so as to forcibly urge the PCV 11 to open and to open the drain valve 10. As a result, the pressure in the evaporated fuel processing system including the fuel tank 5 is regulated to the pressure same as the atmospheric pressure. At the same time, the tank internal pressure valve 17 is opened. Then, at step 12, the initial determination flag $F_{ini}$ is set to "1", whereas a count value t of a diagnostic counter is reset to "0".

At step 13, it is determined whether the count value t of the diagnostic counter reaches a termination timing t1 within the stabilization period from t0 to t1 of the pressure in the evaporated fuel processing system or not. If it is determined to be NO at step 13, that is, if the count value t does not reach the termination timing t1 ($t<t1$), the process after step 14 is skipped so that the process proceeds to step 37 in FIG. 5. In this case, the process exits this routine after the count value t is incremented (step 37). On the other hand, if the diagnosis cycle continues so that the count value t reaches the termination timing t1 ($t \geqq t1$), the process proceeds to step 14 in accordance with the result of positive determination at step 13 as long as the diagnostic cycle continues therefrom.

At step 14, it is determined whether the count value t of the diagnostic counter reaches the termination timing t2 in the estimation time period from t1 to t2 of the generated evaporated fuel amount or not. If it is determined to be NO at step 14, that is, if the count value t does not reach the termination timing t2 ($t1 \leqq t<t2$), the process proceeds to step 15, skipping the process after step 16. At step 15, the drain valve 10 is closed while the tank internal pressure valve 17 is also closed. The drain valve 10 is closed so that the evaporated fuel processing system is completely closed after the internal pressure thereof is regulated to the atmospheric pressure (at the timing t1). Then, at step 37 following step 15, after the count value t is incremented, the process exits this routine.

On the other hand, the diagnostic cycle continues so that the count value t reaches the termination timing t2 in the estimation time period (t≧t2), and then the process proceeds to step 16 in accordance with the result of a positive determination at step 14 as long as the diagnostic cycle continues therefrom. At the step 16, it is determined whether a generated evaporated fuel amount estimation flag $F_{esti}$ is "1" or not. The flag $F_{esti}$ is initially set to "0". In the case where the amount of generated evaporated fuel is estimated, the flag $F_{esti}$ is set to "1". Therefore, in this diagnostic cycle, if the generated evaporated fuel amount is not estimated (the result of a negative determination at step 16), the process proceeds to step 17. On the other hand, once the estimation flag $F_{esti}$ is changed from "0" to "1", the process proceeds to step 20 in accordance with the positive determination at step 16 as long as the diagnostic cycle continues therefrom.

At step 17, the change amount ΔP1 of the internal pressure value $P_{tank}$ is calculated. As described above, by closing the pressure valve 17, the atmosphere introducing passage 16 in communication with the pressure sensor 15 is substantially held to the atmospheric pressure at the timing t1 at which the valve 17 is closed. Therefore, the change amount ΔP1 of the internal pressure value $P_{tank}$ depends on the amount of evaporated fuel generated in the fuel tank 5 without being affected by a variation in the atmospheric pressure. The internal pressure value $P_{tank}$ is gradually increased with the elapsed time as the generated evaporated fuel amount increases. Therefore, the change amount ΔP1 corresponding to a difference between the internal pressure value $P_{tank}$ at the timing t1 and the internal pressure value $P_{tank}$ at the current timing t2 can be regarded as the generated evaporated fuel amount. As described below, the change amount ΔP1 is used as a correction value for estimating the leak amount.

After the flag $F_{esti}$ is set to "1" at step 18, the purge valve 14 is opened (step 19). Since the purge valve 14, which has been closed until then, is opened at step 19, the negative pressure is introduced from the inlet system to the evaporated fuel processing system after the timing t2. As a result, the internal pressure value $P_{tank}$ in communication with the evaporated fuel processing system suddenly decreases. Then, at step 37 following step 19, the process exits the routine after the count value t is incremented.

At step 20, it is determined whether the negative pressure holding flag $F_{hold}$ is "1" or not. The flag $F_{hold}$ is initially set to "0". After completing to introduce the negative pressure to the evaporated fuel processing system, the negative pressure holding flag $F_{hold}$ is set to "1". Therefore, the process proceeds to step 21 in accordance with the result of negative determination at step 20 as long as the negative pressure holding flag $F_{hold}$ is "0". On the other hand, when the flag $F_{hold}$ is changed from "0" to "1", the process proceeds to step 26 in accordance with the result of positive determination at step 20 as long as the diagnostic cycle continues therefrom.

At step 21, the current value of the intake negative pressure value Pi, detected by the intake pressure sensor 23 is added to the negative pressure sum value $P_{insum}$ (an initial value "0") so as to update the negative pressure sum value $P_{insum}$.

Then, at step 22, it is determined whether the internal pressure value $P_{tank}$ reaches the target negative pressure value $P_{trg}$ or not. Since the purge valve 14 is opened at step 19 described above, the internal pressure valve $P_{tank}$ decreases to be closer to the target negative pressure value $P_{trg}$ (that is, the negative pressure in the evaporated fuel processing system becomes deeper) as the diagnostic cycle continues. If it is determined to be NO at step 22, that is, if the internal pressure value $P_{tank}$ is larger than the target negative pressure value $P_{trg}$ ($P_{tank}>P_{trg}$), the process exits this routine after the count value t is incremented (step 37). On the other hand, if the diagnostic cycle continues so that the internal pressure value $P_{tank}$ reaches the target negative pressure value $P_{trg}$ ($P_{tank}\leqq P_{trg}$), the process proceeds to step 23 in accordance with the result of positive determination at step 22.

At step 23 shown in FIG. 5, the purge valve 14 is closed in order to terminate to introduce the negative pressure to the evaporated fuel processing system. By closing the purge valve 14, the evaporated fuel processing system is completely closed after the internal pressure of the evaporated fuel processing system including fuel tank 5 is changed to the target negative pressure value $P_{trg}$ (at the closing timing t3). As a result, the negative pressure holding flag $F_{hold}$ is set to "1" at step 24.

At step 25, in the negative pressure holding that follows the negative pressure introduction, a target holding time period Δt for defining the time period for the negative pressure holding is estimated. The target holding time period Δt is specifically calculated on the basis of the following Formula 1.

$$\Delta t = A \times P_{inave} + B$$

$$P_{inave} = P_{insum}/(t3 - t2) \qquad \text{(Formula 1)}$$

where $P_{inave}$ is an average value of the intake negative pressure values $P_{in}$ within the negative pressure introduction time period from t2 to t3, and A and B are constants, respectively. As can be seen from the Formula 1, the target holding time period Δt is calculated on the basis of the average value $P_{inave}$ of the intake negative pressures $P_{in}$ within the time period from t2 to t3, more specifically, corresponds to a sum value obtained by multiplying the average value $P_{inave}$ of the intake negative pressure values $P_{in}$ by the constant A, and the constant B. The target holding time period Δt calculated by the Formula 1 corresponds to an estimated value (a theoretical value) of the time period required for the internal pressure $P_{tank}$ to reach from the target negative pressure value $P_{trg}$ to the measurement start negative pressure value $P_{str}$, assuming that no leak occurs in the evaporated fuel processing system. The constants A and B in the Formula 1 are appropriately set in advance to values satisfying the above relation through an experiment or a simulation, in view of the overshoot after the pressure is changed to the target negative pressure value $P_{trg}$ and based on the knowledge that the degree of the overshoot depends on the intake negative pressure in the inlet system.

The measurement start negative pressure value $P_{str}$ defines the time of terminating the negative pressure holding so as to transit to the subsequent calculation of the change in the pressure. Specifically, the timing after the elapse of the target holding time period Δt from the closing timing t3 corresponds to diagnostic timing in the early diagnosis, and is variably set in accordance with the target holding time period Δt. The measurement start negative pressure value $P_{str}$ is normally set to be identical with or larger than the target negative pressure value $P_{trg}$. As can be seen from the Formula 1, as the intake negative pressure value $P_{in}$ decreases, the target holding time period Δt decreases to delay the diagnostic timing determined on the basis of the closing timing t3.

Returning to step 26 in FIG. 4, it is determined whether the internal pressure value $P_{tank}$ reaches the measurement start negative pressure value $P_{str}$ or not. Normally, immediately after the purge valve 14 is closed (the timing t3), the overshoot occurs at the transition of the internal pressure value $P_{tank}$ with the elapsed time due to the effects of the preceding negative pressure introduction. Therefore, since the internal pressure value $P_{tank}$ initially becomes smaller than the measurement start negative pressure value $P_{str}$ ($P_{tank}<P_{str}$), the process proceeds to step 27 in accordance with the result of negative determination at step 26.

At step 27, it is determined whether the count value t of the diagnostic counter reaches timing $t_{diag}$ (diagnostic timing) after the elapse of the target holding time period Δt from the closing timing t3 or not. If it is determined to be NO at step 27, that is, if the count value t does not reach the diagnostic timing $t_{diag}$ ($t3 \leqq t<t_{diag}$), the process exits the routine after the count value t is incremented (step 37). On the other hand, if it is determined to be YES at step 27, that is, if the count value t reaches the diagnostic timing $t_{diag}$ ($t \geqq t_{diag}$), the process proceeds to step 32. As described above, the target holding time period Δt corresponds to an estimated time period required for the internal pressure value $P_{tank}$ to reach from the target negative pressure value $P_{trg}$ to the measurement start negative pressure value $P_{str}$ after the closing timing t3 . Therefore, if the internal pressure value $P_{tank}$ does not reach the measurement start negative pressure value $P_{str}$ even after the elapse of the target holding time period Δt, it is determined that the leak amount is small (early diagnosis) to give the result of the diagnosis "normal" without any diagnosis based on the change amount in the internal pressure value $P_{tank}$ (the case of the timing chart shown in FIG. 6).

On the other hand, if it is determined to be YES at step 26, that is, if the internal pressure $P_{tank}$ reaches the measurement start negative pressure value $P_{str}$ before the count value t reaches the above-described diagnostic timing $t_{diag}$ ($P_{tank} \geqq P_{str}$, $t<t_{diag}$), the process proceeds to step 28 (at the timing t4). In this case, a normal leak diagnosis is executed in the process after step 28 (the case of a timing chart shown in FIG. 7).

At step 28, the change amount ΔP2 of the internal pressure value $P_{tank}$ is calculated. As described above, since the tank internal pressure valve 17 is closed, the atmosphere introducing passage 16 of the pressure sensor 15 is still held to the atmospheric pressure at the time when the valve 17 was closed. Therefore, the change amount ΔP2 depends on the evaporated fuel amount generated in the fuel tank 5 and the leak amount caused in the evaporated fuel processing system. The change amount ΔP2 can be specified by calculating the difference between the internal pressure value $P_{tank}$ at the timing t4 and the internal pressure value $P_{tank}$ at the current timing t.

At step 29, it is determined whether the count value t of the diagnostic counter reaches the termination timing t5 within a pressure change calculation time period from t4 to t5 or not. If it is determined to be NO at step 29, that is, if the count value t does not reach the termination timing t5, the process after step 30 is skipped. Then, after the count value t is incremented (step 37), the process exits the routine. On the other hand, if the count value t reaches the termination timing t5, the process proceeds to step 30 in accordance with the result of positive determination at step 29.

At step 30, a diagnostic value $D_{iag}$ for determining whether there is the leak in the evaporated fuel processing system including the fuel tank 5 or not is estimated on the basis of the difference between the two calculated amounts of change ΔP1 and ΔP2. The change amount ΔP2 corresponds to the change amount in the internal pressure value $P_{tank}$ within the time period from t4 to t5 and is affected not only by the leak in the evaporated fuel processing system but also by the generated evaporated fuel. Therefore, the value obtained by multiplying the change amount ΔP1 specifically due to the generation of evaporated fuel by a weighting coefficient k (a value of k is determined by the capacity of the fuel tank and the like (for example, 2.0)) is subtracted from the change amount ΔP2. As a result, the change amount in pressure corresponding to the leak amount in the evaporated fuel processing system can be obtained as the diagnostic value $D_{iag}$. The diagnostic value $D_{iag}$ means that the leak amount in the evaporated fuel processing system is larger as the diagnostic value $D_{iag}$ is larger.

At step 31, it is determined whether the diagnostic value $D_{iag}$ is smaller than a first criterion threshold value $P_{th1}$ (for example, 600 pa) or not. If the diagnostic value $D_{iag}$ is smaller than the threshold value $P_{th1}$, that is, if the leak amount is small, the result of the diagnosis "normal" is given (step 32). On the other hand, the diagnostic value $D_{iag}$ is equal to or larger than the threshold value $P_{th1}$, the process proceeds to step 33.

At step 33, it is determined whether the diagnostic value $D_{iag}$ is equal to or larger than a second criterion threshold value $P_{th2}$ (for example, 800 pa) or not. If the diagnostic value $D_{iag}$ is equal to or larger than the threshold value $P_{th2}$, that is, if the leak amount is large, the result of diagnosis "abnormal" is given (step 34). On the other hand, if the diagnostic value $D_{iag}$ is smaller than the threshold value $p_{th2}$ and equal to or larger than the threshold value $P_{th1}$, it is determined neither as "normal" nor as "abnormal". In this case, after the initial determination flag $F_{in}$ is reset to "0"in order to re-execute the diagnostic cycle (step 35), the process exits the routine.

Then, at step 36 following step 32 or 34, the diagnosis execution flag $F_{diag}$ is changed from "0" to "1" so that the process exits this routine. Although not described in details, the result of the leak diagnosis is recorded in a leak NG flag stored in a backup RAM of the ECU 18 (for example, normal when the leak NG flag=0 is established, and abnormal when the leak NG flag is 1). Then, a portable failure diagnostic device (serial monitor) is connected to an external connection connector (not shown) of the ECU 18 so as to read out a value of the leak NG flag to know the result of the leak diagnosis. In the case of determination of leak abnormality, an alarm lamp 27, which is provided in an instrument panel and is connected to an output port of the ECU 18, is lighted so as to inform a driver of an abnormality presence.

As described above, according to this embodiment, the purge valve 14 is opened so as to introduce the negative pressure from the inlet system to the evaporated fuel processing system at the timing t2. Then, the internal pressure value $P_{tank}$ reaches the target negative pressure value $P_{trg}$ so that the purge valve 14 is closed to close the evaporated fuel processing system at the closing timing t3. The average value $P_{inave}$ of the intake negative pressure values $P_{in}$ within the negative pressure introduction time period from t2 to t3 is calculated on the basis of the intake negative pressure value $P_{in}$ detected by the intake pressure sensor 23. At the same time, the estimated value of the negative pressure holding time period (target holding time period) Δt is calculated on the basis of the average value $P_{inave}$. Then, after the elapse of the target holding time period Δt from the closing timing t3, the internal pressure value $P_{tank}$ and the measurement start negative pressure value $P_{str}$ are compared with each other. In this case, if the internal pressure value $P_{tank}$ is smaller than the measurement start negative pressure value $P_{str}$, the result of diagnosis "normal" is given.

For example, if an intake negative pressure is shallow as in the case of a high load, the degree of the overshoot is relatively small and accordingly its time period is also short. Since the holding time period of the negative pressure is fixedly set, assuming the case where an overshoot time period becomes the maximum in the conventional early diagnosis, it is difficult to optimize the time required for leak diagnosis. In this embodiment, however, the target holding time period Δt is calculated on the basis of the knowledge that the degree of the overshoot of the internal pressure value $P_{tank}$ after the introduction of the negative pressure (that is, within the time period from the closing timing t3 to the diagnostic timing t4) changes in accordance with the intake negative pressure value $P_{in}$ at the introduction of the negative pressure. Therefore, the diagnostic timing of the early diagnosis can be appropriately set; for example, the target holding time period Δt is set at a small value in the case where the overshoot time period is short. As a result, the time period required for the leak diagnosis can be optimized with the reduced diagnostic timing.

Moreover, in the conventional early diagnosis, if the intake negative pressure is shallow, the overshoot degree is small. Therefore, at the timing after the elapse of the fixedly set holding time period, the internal pressure value $P_{tank}$ is equal to or larger than the measurement start negative pressure value $P_{str}$. It is determined that the pressure in the evaporated fuel processing system returns to the measurement start pressure value $P_{str}$ in this case, and therefore, the early diagnosis is not executed. In such a case, even if the leak amount falls within a normal range, the result of diagnosis cannot be obtained unless the normal leak diagnosis is performed on the basis of the change amount. As a result, there arises inconvenience that the diagnostic time period becomes longer. However, by appropriately setting the target holding time period Δt as in this embodiment, the scope of application of the early diagnosis can be enlarged.

In the case where the leak amount is large or a filler cap of the fuel tank 5 is removed, there is a possibility that the internal pressure value $P_{tank}$ does not reach the target negative pressure value $P_{trg}$. Therefore, in the case of the result of negative determination at step 22 described above (the internal pressure value $P_{tank}$>the target negative pressure value $P_{trg}$), if a predetermined time period of the negative pressure introduction time period (the count value t2-t3) elapses, the leak diagnosis may be interrupted. In these cases, there is a possibility that the internal pressure value $P_{tank}$ does not reach a minimum pressure $P_{tpeak}$ within the negative pressure holding time period. Therefore, in the case also where the minimum pressure $P_{tpeak}$ is not detected as a detected value of the internal pressure value $P_{tank}$, the leak diagnosis may be interrupted. As a result, the execution of diagnosis can be appropriately interrupted in the case where the leak diagnosis cannot be normally executed.

While there has been described what are at present considered to be preferred embodiments of the present invention, it will be understood that various modifications may be made thereto, and it is intended that the appended claims cover all such modifications as fall within the true spirit and the scope of the present invention.

What is claimed is:

1. A diagnostic device of an evaporated fuel processing system for closing an evaporated fuel processing system including a fuel tank after introducing a negative pressure into the evaporated fuel processing system to execute a leak diagnosis of the evaporated fuel processing system, comprising:

an internal pressure detection section for detecting an internal pressure of the evaporated fuel processing system;

an intake pressure detection section for detecting an intake negative pressure of an inlet system;

a control section for closing the evaporated fuel processing system at a closing timing wherein the internal pressure detected by the internal pressure detection section reaches a preset target pressure value when the negative pressure is introduced from the inlet system to the evaporated fuel processing system;

a diagnostic section for comparing the internal pressure value at a diagnostic timing set to come after the closing timing with a preset criterion threshold value to execute the leak diagnosis of the evaporated fuel processing system; and a calculation section for variably setting the diagnostic timing based on the intake negative pressure value detected by the intake pressure detection section.

2. The diagnostic device according to claim 1, wherein the calculation section delays more the diagnostic timing determined on the basis of the closing timing as the intake negative pressure value becomes smaller.

3. The diagnostic device according to claim 1, wherein the calculation section sets the diagnostic timing based on an average value of the intake negative pressure values for a time period when the negative pressure is introduced to the evaporated fuel processing system.

4. The diagnostic device according to claim 1, wherein the diagnostic section determines that no leak occurs in the evaporated fuel processing system if the internal pressure value at the diagnostic timing is smaller than the criterion threshold value.

5. A diagnostic method of an evaporated fuel processing system for closing an evaporated fuel processing system including a fuel tank after introducing a negative pressure into the evaporated fuel processing system to execute a leak diagnosis of the evaporated fuel processing system, the diagnostic method comprising the steps of:

introducing the negative pressure from an inlet system to the evaporated fuel processing system;

closing the evaporated fuel processing system at closing timing when a value of an internal pressure detected as the internal pressure of the evaporated fuel processing system reaches a preset target pressure value;

setting variably a diagnostic timing after the closing timing based on an intake negative pressure value detected as an intake negative pressure of the inlet system; and comparing the internal pressure value at the diagnostic timing with a preset criterion threshold value so as to execute the leak diagnosis of the closed evaporated fuel processing system.

6. The diagnostic method according to claim 5, wherein the setting step delays more the diagnostic timing determined on the basis of the closing timing as the intake negative pressure value becomes smaller.

7. The diagnostic method according to claim 5, wherein the setting step sets the diagnostic timing based on an average value of the intake negative pressure values for a time period when the negative pressure is introduced to the evaporated fuel processing system.

8. The diagnostic method according to claim 5, wherein the comparing step determines that no leak occurs in the evaporated fuel processing system if the internal pressure value at the diagnostic timing is smaller than the criterion threshold value.

* * * * *